United States Patent [19]

Koizumi et al.

[11] Patent Number: 4,612,040

[45] Date of Patent: Sep. 16, 1986

[54] CONSUMABLE ELECTRODE FOR PRODUCTION OF NB-TI ALLOYS

[75] Inventors: Masaaki Koizumi, Yokohama; Nobuo Fukada; Hiroyuki Okano, both of Samukawa, all of Japan

[73] Assignee: Toho Titanium Co., Ltd., Tokyo, Japan

[21] Appl. No.: 735,136

[22] Filed: May 17, 1985

[30] Foreign Application Priority Data

May 29, 1984 [JP] Japan ..... 59-107478

[51] Int. Cl.[4] ..... C22B 4/00

[52] U.S. Cl. ..... 75/10.65

[58] Field of Search ..... 75/10 R, 10 C, 10 V

[56] References Cited

U.S. PATENT DOCUMENTS 2,974,033 3/1961 Krieger ..... 75/10 V 3,565,602 2/1971 Konisi ..... 75/10 C

*Primary Examiner*—Peter D. Rosenberg

*Attorney, Agent, or Firm*—Oblon, Fisher, Spivak, McClelland & Maier

[57] ABSTRACT

A consumable electrode for the production of Nb-Ti alloy is disclosed which is capable of obtaining homogeneous titanium alloy without segregation which contains substantially equal amounts of niobium and titanium. The consumable electrode consists essentially of a compact formed by compressing a uniform mixture of niobium chips and sponge titanium.

8 Claims, 1 Drawing Figure

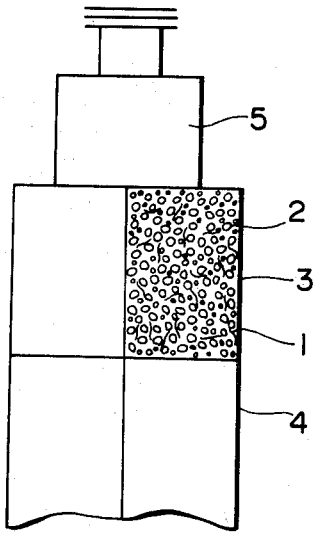
5
2
3
1
4

CONSUMABLE ELECTRODE FOR PRODUCTION OF NB-TI ALLOYS

BACKGROUND OF THE INVENTION

1. Field of the Invention

This invention relates to a consumable electrode for the production of alloys consisting of two or more active high melting point metals, and more particularly to a consumable electrode useful for the production of Nb-Ti alloys using vacuum arc melting techniques.

2. Description of the Prior Art

Nb-Ti alloys are conventionally produced by first forming a consumable electrode. The consumable electrode is arc or electron beam melted in a closed vessel in a vacuum or inert atmosphere to form an ingot. Inasmuch as the closed vessel is cooled by water or the like, the melted metal is rapidly cooled and gradually solidified in a lamellar manner in vertical direction, which makes it difficult to produce Nb-Ti alloys of homogeneous micro-structure without segregation.

Further, Ti has a melting point of 1668° C. and specific gravity of 4.54, whereas Nb has a melting point of 2468° C. and specific gravity of 8.57. This renders the production of Nb-Ti alloy ingots of homogenous microstructure without segregation by vacuum arc melting techniques using the conventional consumable electrode substantially impossible. In order to overcome the problem described above, many proposals have been made for the titanium-base consumable electrode which contains a high melting point alloying element in amount of several weight percent. However, these proposals are silent concerning the titanium base consumable electrode which contains the high-melting point alloying element at a level as high as about 50 wt. % or more.

The conventional consumable electrode for producing alloys consisting essentially of high-melting active metals is typically produced by thoroughly mixing the base metal and alloying elements and compacting the particles thereof. In the production of such a consumable electrode, when the difference in bulk density and particle size between the alloying element metal powder and the base metal powder is relatively small, it is possible to mix substantially uniformly both metal powders. However, in the consumable electrode for the production of Nb-Ti alloys, sponge titanium and niobium powder are highly different in particle size and bulk density, because sponge titanium has an average particle size of about 0.8–13 mm and bulk density of about 1.3, whereas niobium powder has an average particle size of about 0.07–1.0 mm and a bulk density of about 4.5. Thus, it is highly difficult to uniformly mix the sponge titanium and niobium powder together.

It is also known in the art to form a consumable electrode by alternately superposing a plurality of thin base metal sheets and a plurality of thin alloying element sheet on one another in the longitudinal direction. However, the consumable electrode of this type is disadvantageous in that the production of the thin metal sheets requires much cost and it is highly difficult to carry out welding in a chamber of an inert gas atmosphere.

A further consumable electrode known in the art is produced by throughly mixing matrix metal powder and alloying element metal powder to prepare a substantially homogeneous mixture thereof and subjecting the mixture to compression. Thereafter, the compressed mixture is placed at the center of matrix metal, to thereby form a compact. However, in the consumable electrode of this type, titanium powder used as a base metal in the electrode has a high oxygen content and expensive. Furthermore, the compacted mixture of matrix metal powder and alloying metal powder placed in the matrix metal makes it impossible to form the consumable electrode containing substantially equal amounts of niobium and titanium.

SUMMARY OF THE INVENTION

The present invention has been made in view of the foregoing disadvantages of the prior art.

Accordingly, it is an object of the present invention to provide a consumable electrode for the production of titanium alloy which is free of segregation and contains substantially equal amounts of niobium and titanium.

In accordance with the present invention, there is provided a consumable electrode for the production of Nb-Ti alloys comprising a compact formed by compressing a uniform mixture of niobium chips and sponge titanium.

BRIEF DESCRIPTION OF THE DRAWINGS

The exact nature of this invention, as well as other objects and advantages thereof will be apparent from consideration of the following specification relating to the annexed drawing in which:

In the drawing, the single FIGURE is a vertical sectional view showing an example of a consumable electrode according to the present invention.

DETAILED DESCRIPTION OF THE INVENTION

The niobium chips or cuttings used in the present invention may be prepared by turning an ingot of niobium by means of a suitable cutting machine such as a lathe and pulverizing the resultant niobium turnings. The degree of pulverization is selected depending upon the bulk density of the sponge titanium to be used. The niobium turnings are pulverized to the extent necessary to produce chips having a bulk density similar to that of the titanium sponge utilized. Typically, the ratio of niobium bulk density to the sponge titanium bulk density will be in the range of from 0.5 to 3:1; preferably from 1 to 1.5:1. The niobium chips preferably have dimensions of 5 mm or less in thickness, 50 mm or less in width and 300 mm or less in length. Influence of turning and pulverizing on the quality of niobium chips are shown in Table 1.

TABLE 1

Influence of Turning and Pulverizing of Niobium Ingot on Quality of Niobium Chips

| Analytical Component | Circumferential Speed (cm/sec) 19 | 29.3 | 38.9 | Analytical Values of Ingot |
|---|---|---|---|---|
| O (wt. %) | 0.008 | 0.010 | 0.008 | 0.009 |
| N (wt. %) | 0.005 | 0.004 | 0.005 | 0.004 |

As is apparent from Table 1, the contamination of niobium chips by oxygen and nitrogen due to the turning and pulverizing does not occur.

Then, the niobium chips thus prepared are uniformly mixed with conventional sponge titanium. Generally, the sponge titanium will have 50 mm or less in average particle size but larger particles may be used if the bulk densities of the niobium and titanium are similar to prepare an admixture, and the admixture is subjected to compression to form compacts which are, in turn, welded to form a consumable electrode of the present invention.

Now, the present invention will be further described hereinafter by way of an example.

EXAMPLE

The single FIGURE is a vertical sectional view showing a consumable electrode which was prepared according to the present invention. In order to prepare the consumable electrode shown in the FIGURE, an ingot of niobium was turned at a circumferential speed of 38.9 cm/sec by means of a lathe and pulverized to obtain niobium chips 1 having dimensions of 0.2 mm in thickness, 3 mm in width and 40 mm in length. The niobium chips were then mixed with sponge titanium 2 of 0.8–13 mm in average particle size in a vessel to prepare the admixture. Thereafter, the mixture was charged in a press die and subjected to compression molding, thereby to obtain a compact 3. The difference in bulk density between niobium chips and sponge titanium used was small because the chips and sponge were about 1.7 and about 1.3 in bulk density, respectively. Thus, the admixing of both materials were facilitated. In the present invention, turnings of titanium may be used instead of sponge titanium.

Subsequently, the compact 3 was subjected to welding to prepare a consumable electrode 4. Reference numeral 5 designates a connector for power supply source. The consumable electrode 4 was subjected to double-melting according to vacuum arc melting techniques to obtain an ingot of 1,000 kg which contains about 45 wt. % of titanium. Table 2 shows results of a segregation test carried out on the ingot.

TABLE 2

| Results of Segregation Test on Nb-45 wt. % Ti Alloy | | | | |
|---|---|---|---|---|
| Analytical Test (Ti: wt. %) Sampling Position | | | Physical Segregation Test | |
| Top | Middle | Bottom | Microscopy Test | X-Ray Test Roentgenology |
| 45.1 | 45.0 | 45.1 | No Segregation | No Segregation |

As can be seen from Table 2, homogenous ingot is obtained from the consumable electrode of the present invention by employing double-melting.

The present invention, as shown in Table 2, can provide alloy of homogenous microstructure without segregation by double-melting because the double-melting of the consumable electrode does not allow non-melted niobium to remain in the ingot. Also, in the present invention, niobium in the shape of a thin chip facilitates the melting of niobium having a high melting point, and titanium and niobium are microscopically uniformly mixed together, resulting in stable melting as in pure titanium. Further, niobium is generally formed into an ingot by chemical refining followed by electron beam melting techniques. Thus, the ingot is produced at a cost lower than niobium powder. Accordingly, the use of niobium chips formed by the turning of the ingot in the present invention renders the manufacturing cost substantially low as compared with the preparation of niobium powder. Thus, it will be noted that the consumable electrode of the present invention is highly suitable for the production of Nb-Ti alloys which are generally used as a material for superconductive elements, fasteners of an aircraft. The consumable electrode of the present invention allows the production of desired homogenous alloy without segregation even when containing niobium at a level as high as about 40–60 wt. %.

Obviously many modifications and variation of the present invention are possible in the light of the above teachings. It is therefore to be understood that within the scope of the appended claims the invention may be practiced otherwise than as specifically described.

What is claimed as new and desired to be secured by Letters Patent of the United States:

1. A consumable electrode for the production of NbTi alloys consisting essentially of a compact body formed by compressing a uniform mixture of niobium chips of not more than 5 mm in thickness, no more than 50 mm in width and no more than 300 mm in length, and sponge titanium.

2. A consumable electrode as defined in claim 1, wherein said sponge titanium has a uniform particle size of 50 mm or less.

3. A consumable electrode as defined in claim 1, wherein the content of niobium is 40–60% by weight.

4. A consumable electrode comprising a compacted, uniform admixture of niobium chips and sponge titanium wherein said niobium chips and sponge titanium prior to compaction have similar bulk densities.

5. The consumable electrode of claim 4 wherein the ratio of niobium chip bulk density to sponge titanium bulk density is from 0.5 to 3.0:1.

6. The consumable electrode of claim 4 wherein the ratio of niobium chip bulk density to sponge titanium bulk density is from 1.0 to 1.5:1.

7. The consumable electrode of claim 4, wherein the niobium content is 40–60 wt. %.

8. A method of preparing a niobium-titanium alloy having a homogenous microstructure which comprises melting a compacted uniform admixture of niobium chips and sponge titanium wherein said niobium chips and sponge titanium prior to compaction have similar bulk densities.

* * * * *